US005392673A

United States Patent [19]

Scott

[11] Patent Number: 5,392,673

[45] Date of Patent: Feb. 28, 1995

[54] TOOL HANDLE

[76] Inventor: Russell K. Scott, P.O. Box 404, Tompkinsville, Ky. 42167

[21] Appl. No.: 88,370

[22] Filed: Jul. 9, 1993

[51] Int. Cl.[6] ..... B25G 1/04

[52] U.S. Cl. ..... 81/177.2; 81/490

[58] Field of Search ..... 81/177.2, 177.4, 177.85, 81/489, 490; 403/107, 109

[56] References Cited

U.S. PATENT DOCUMENTS 4,070,932 1/1978 Jeanotte ..... 81/177.2

5,285,702 2/1994 Hillinger ..... 81/177.2

*Primary Examiner*—D. S. Meislin

*Attorney, Agent, or Firm*—E. Michael Combs

[57] ABSTRACT

A tool handle having a tool head mounted at a first end of the tool handle includes a handle shaft telescopingly mounted within the tool handle arranged for securement within the associated handle tube in a first position and projecting the handle tube in a second position to provide for increased application of leverage and torque in use of the tool head.

4 Claims, 4 Drawing Sheets

TOOL HANDLE

BACKGROUND OF THE INVENTION

1. Field of the Invention

The field of invention relates to tool handle structure, and more particularly pertains to a new and improved tool handle wherein the same is arranged for extensible construction permitting enhanced application of torque.

2. Description of the Prior Art

Typically, the prior art has heretofore employed fixed tool handles relative to a tool head permitting the enhanced torque application, wherein the instant invention attempts to overcome deficiencies of the prior art by employing a tool handle having a handle tube including a telescoping shaft arranged for extension therefrom in a locking arrangement and in this respect, the present invention substantially fulfills this need.

SUMMARY OF THE INVENTION

In view of the foregoing disadvantages inherent in the known types of tool handle structure now present in the prior art, the present invention provides a tool handle wherein the same employs a handle shaft telescopingly mounted relative to an associated handle tube. As such, the general purpose of the present invention, which will be described subsequently in greater detail, is to provide a new and improved tool handle which has all the advantages of the prior art tool handles and none of the disadvantages.

To attain this, the present invention provides a tool handle having a tool head mounted at a first end of the tool handle, including a handle shaft telecopingly mounted within the tool handle arranged for securement within the associated handle tube in a first position and projecting the handle tube in a second position to provide for increased application of leverage and torque in use of the tool head.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool handle which has all the advantages of the prior art tool handles and none of the disadvantages.

It is another object of the present invention to provide a new and improved tool handle which may be easily and efficiently manufactured and marketed.

It is a further object of the present invention to provide a new and improved tool handle which is of a durable and reliable construction.

An even further object of the present invention is to provide a new and improved tool handle which is susceptible of a low cost of manufacture with regard to both materials and labor, and which accordingly is then susceptible of low prices of sale to the consuming public, thereby making such tool handles economically available to the buying public.

Still yet another object of the present invention is to provide a new and improved tool handle which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
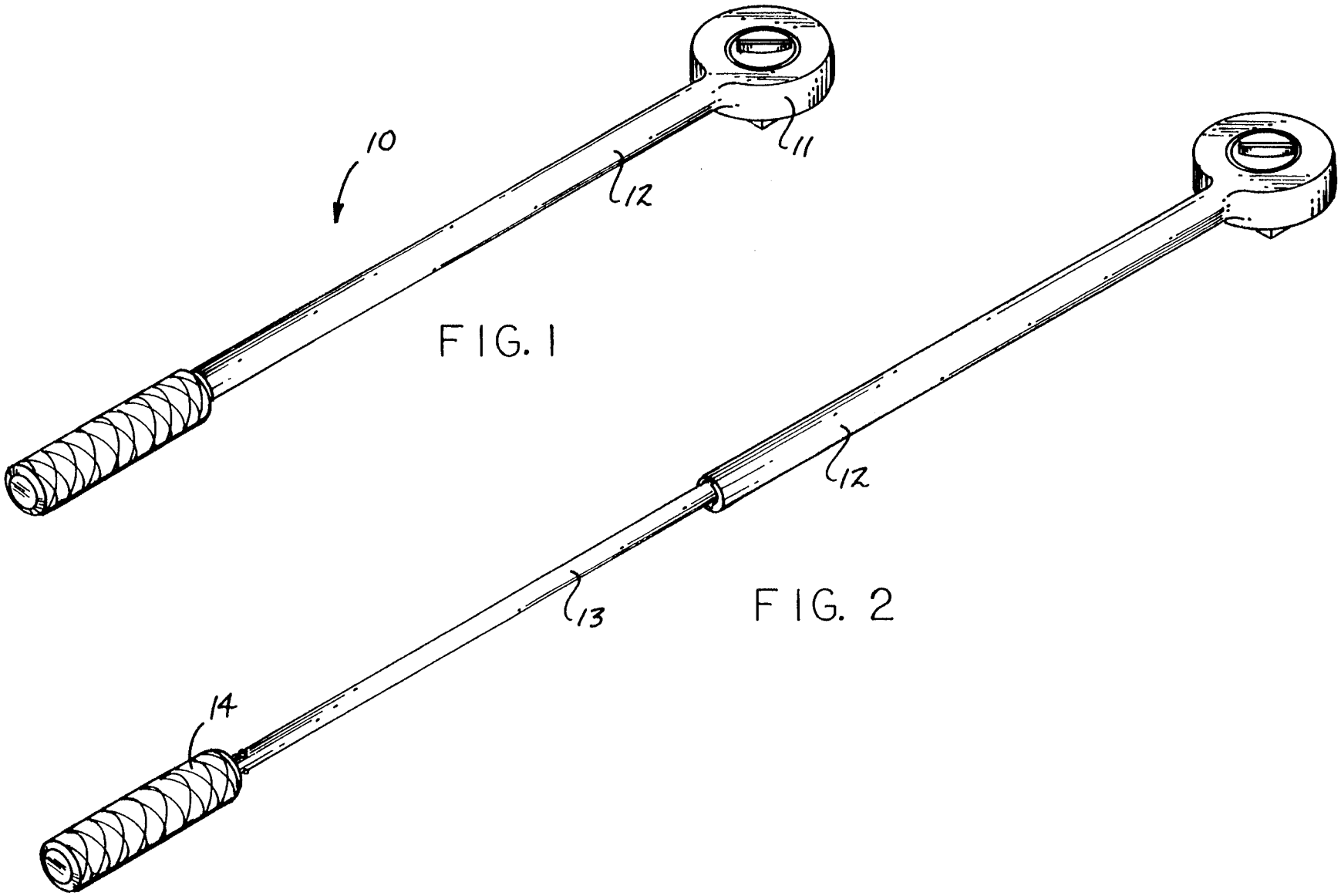
FIG. 1 is an isometric illustration of the invention in a first position.
FIG. 2 is an isometric illustration of the invention with a handle configured in a second position having the handle shaft extending from the associated handle tube.

With reference now to the drawings, and in particular to FIGS. 1 to 8 thereof, a new and improved tool handle embodying the principles and concepts of the present invention and generally designated by the reference numeral 10 will be described.

Figures 3, 4:
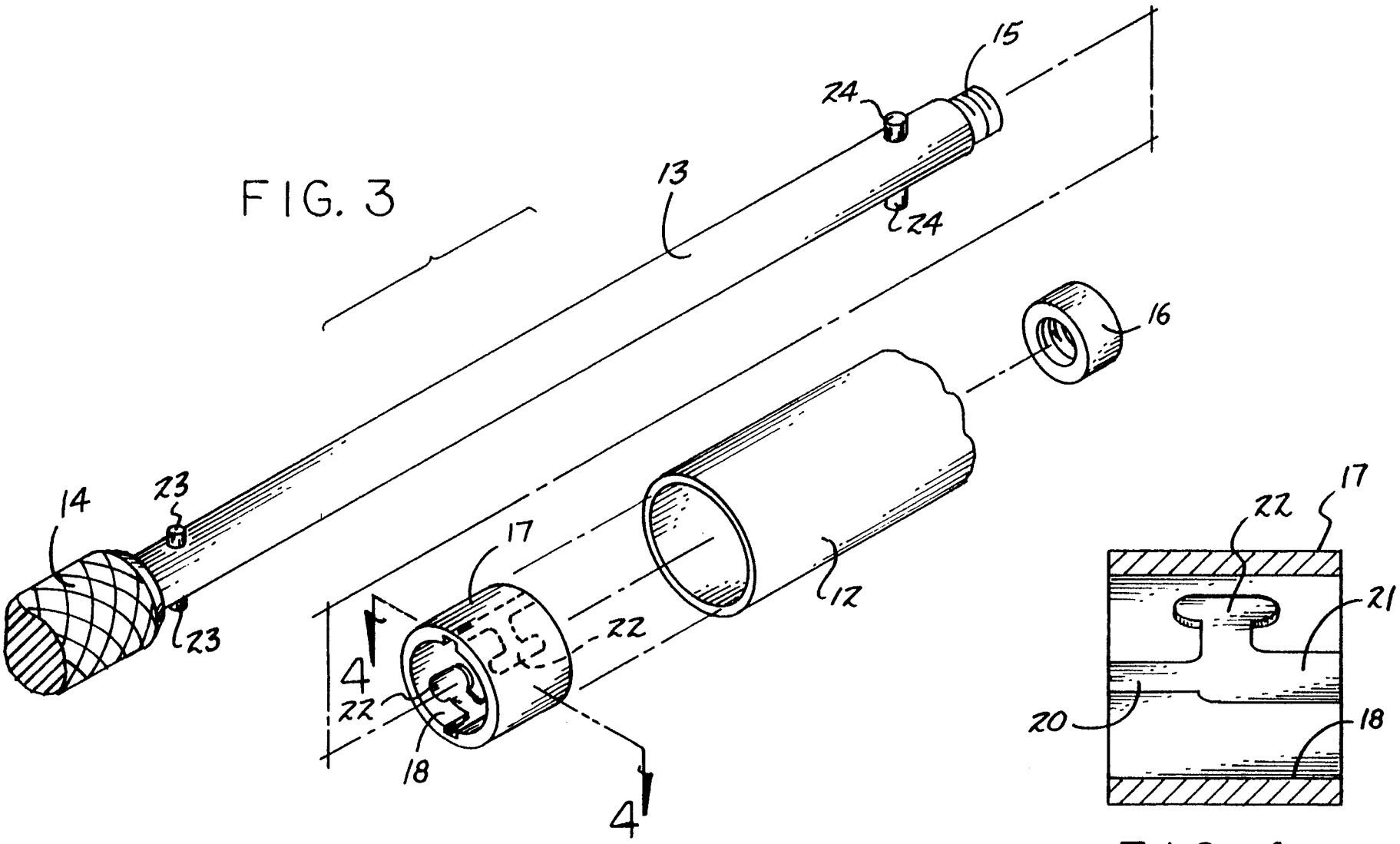
FIG. 3 is an isometric exploded view indicating the various components of the handle shaft arranged for mounting within the handle tube.
FIG. 4 is an orthographic view, taken along the lines 4—4 of FIG. 3 in the direction indicated by the arrows.
Figure 5:
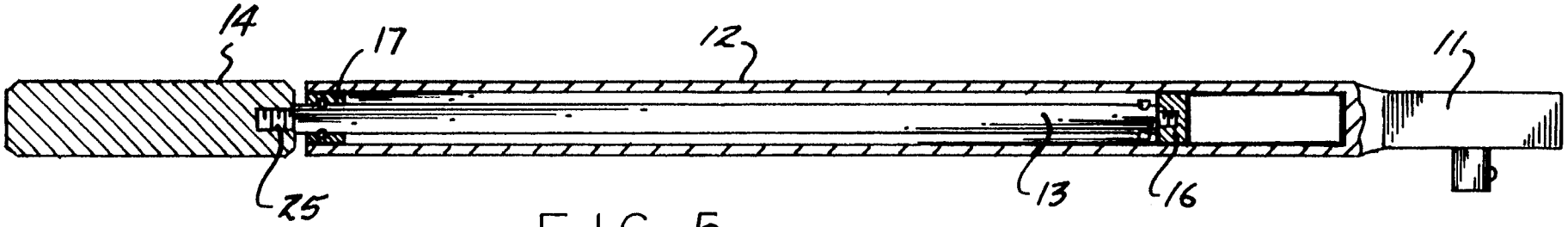
FIG. 5 is an orthographic side view, partially in section, of the torque handle structure.

More specifically, the tool handle 10 of the instant invention essentially comprises a handle tube 12 mounting a tool head 11 at a first end of the handle tube with the second end of the handle tube reciprocatably and telescopingly receiving a handle shaft 13 in a coaxially aligned relationship. The handle shaft 13 includes a grip handle 14 mounted at a second end of the shaft 13, with a first end of the shaft 13 having a shaft threaded boss 15. A handle tube threaded collar 16 is fixedly secured and coaxially aligned within the handle tube 12 in adjacency to the handle head 11, as indicated in FIG. 5. The shaft threaded boss 15 accordingly is arranged for securement to the threaded collar 16 to secure and nest the handle shaft 13 within the handle tube 12 in a first position, as indicated in FIG. 1. The handle shaft 13 includes first lock pins 23 of a first diameter fixedly mounted to the handle shaft in adjacency to the handle shaft second end, wherein second lock pins 24 of a second diameter greater than said first diameter are fixedly mounted in a longitudinally aligned relationship relative to one another in adjacency to the handle shaft first end, as illustrated in FIG. 3 for example. To enhance securement of the handle shaft within the handle tube, a plurality of diametrically opposed parallel guide grooves are positioned in a parallel diametrically opposed relationship of a mirror image configuration positioned within a handle tube locking collar 17 mounted adjacent the handle tube second end at an entrance opening, such that the locking collar includes a locking collar interior cylindrical wall having said grooves therewithin. Each of the grooves includes a first groove portion 20 of a first width extending from the handle tube entrance end in communication with a second groove portion 21 of a second width greater than said first width. The first width is substantially equal to the first diameter, wherein the second width is substantially equal to the second diameter. A generally T-shaped capture recess 22 orthogonally intersects the second groove portion 21 permitting reception of the respective first and second locking pins 23 and 24 within the T-shaped capture recesses 22 that are of a mirror image orientation relative to one another when the handle shaft is in the respective first and second positions, such as indicated in the respective FIGS. 1 and 2. Contrarotation of the shaft 13 relative to the collar 17 disengages the locking pins relative to the T-shaped recesses, as indicated, whereupon conversely, clockwise rotation of the shaft 13 relative to the T-shaped capture recesses 22 permits selective reception of the locking pins therewithin relative to positions of the FIGS. 1 and 2.

Figure 6:
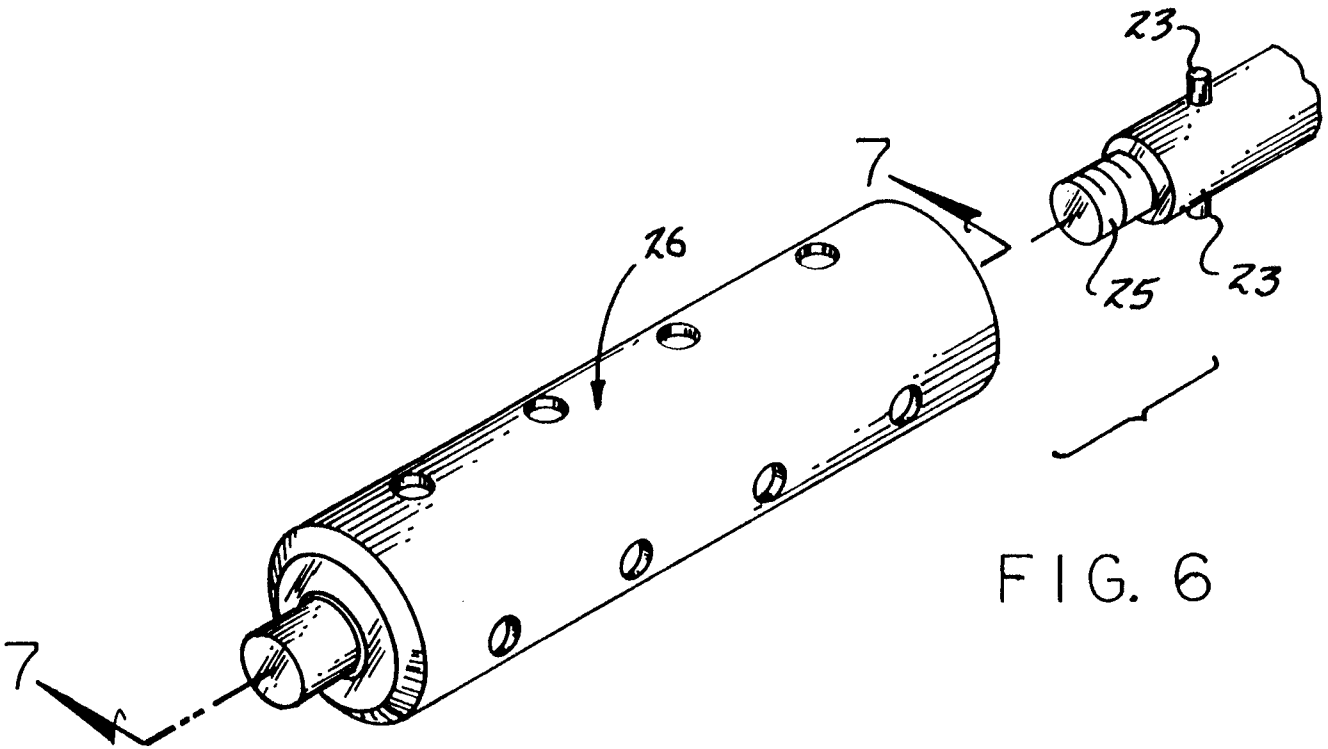
FIG. 6 is an isometric illustration of a modified dispensing handle mounted to an outer distal end of the handle shaft.
Figure 7:
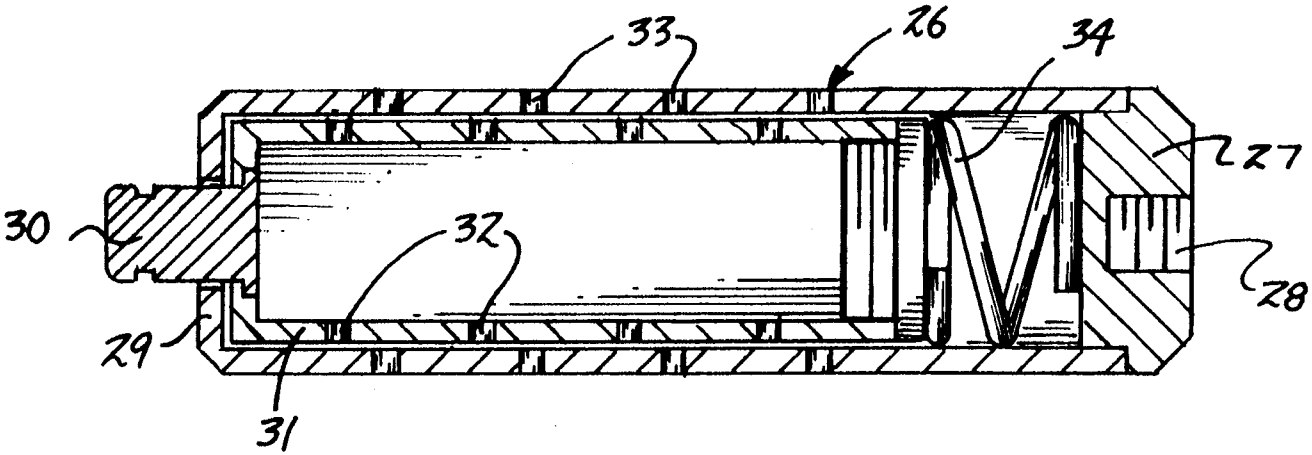
FIG. 7 is an orthographic view, taken along the lines 7—7 of FIG. 6 in the direction indicated by the arrows.
Figure 8:
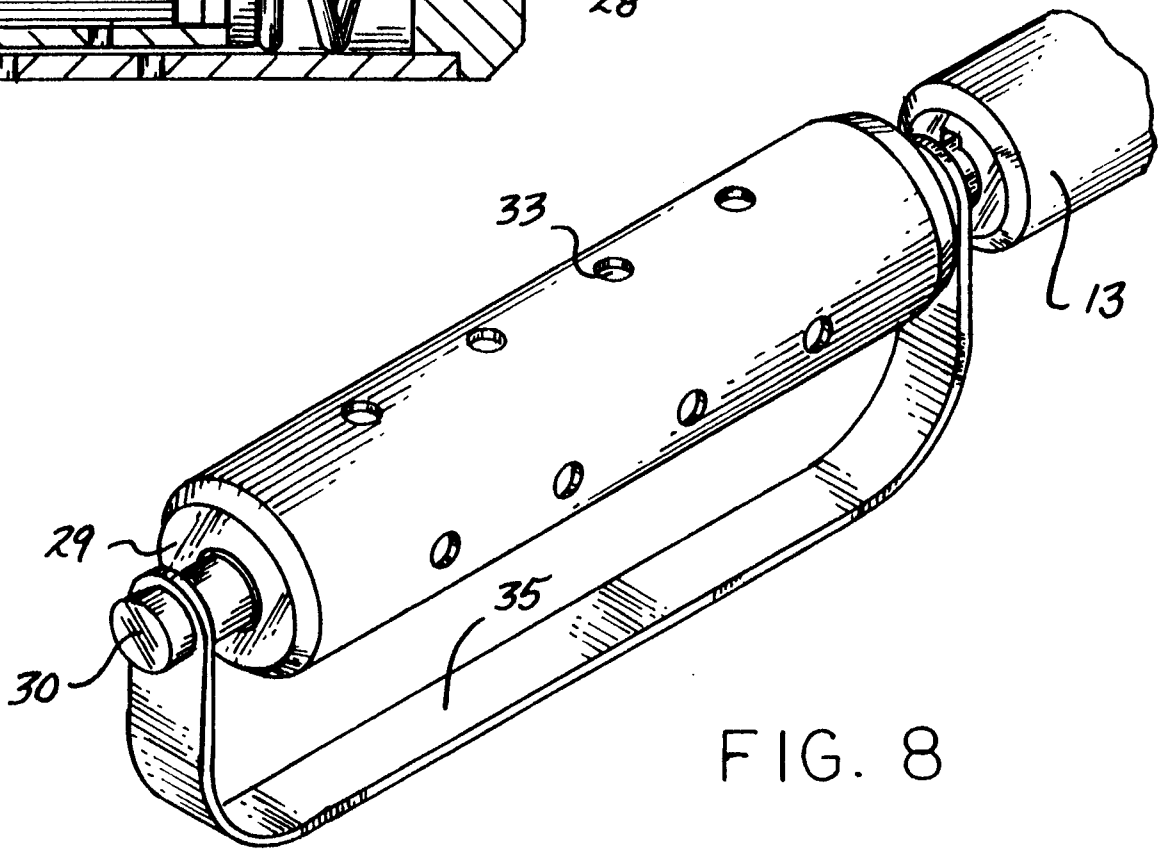
FIG. 8 is an isometric illustration of the dispensing handle having a handle strap secured thereto.

A handle mounting boss 25 is mounted to the shaft 13 at the shaft second end for securement selectively of the grip handle 14 or of a dispensing handle 26 thereto, in a manner as indicated in FIG. 6. The dispensing handle 26 includes a first end wall 27 spaced from a second end wall 29 (see FIG. 7). The first end wall 27 includes a threaded bore 28 for threaded securement to the handle mounting boss 25, wherein the second end wall 29 includes a reciprocatably mounted plunger 30 projecting interiorly of the dispensing handle 26 coaxially aligned therewith fixedly mounted to a reservoir cylinder 31, having a reservoir cylinder length substantially less than the dispensing handle length, whereupon a reservoir cylinder spring 34 is captured between the reservoir cylinder and the first end wall 27 within the dispensing handle 26. The reservoir cylinder 31 includes reservoir cylinder apertures 32 misaligned relative to handle side wall apertures 33, whereupon projection of the plunger 30 within the handle 26 effects alignment of the apertures and ease of dispensing of a rosin-like powder contained within the reservoir cylinder 31. The rosin-like powder is available to enhance grasping of the handle structure during use. Further, various powders may be dispensed such as talcum and the like whereupon replenishment of such powders may be effected by access to the reservoir cylinder 31 by removal of the first end wall 27 and its securement by various mechanical means such as fasteners and the like (not shown). A resilient handle strap 35 defining a U-shaped loop is mounted at its first end to the plunger 30 at its second end about the handle mounting boss 25 to further enhance grasping of the dispensing handle when resilient construction of a memory retentive material featuring "spring-back" of the material subsequent to use permits ease of employment of the plunger in its dispensing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and desired to be protected by Letters Patent of the United States is as follows:

1. A tool handle, comprising, an elongate handle tube, having a handle tube first end spaced from a handle tube second end, with the second end having an entrance opening directed into the handle tube, the handle tube first end having a tool head fixedly mounted thereon, and a handle shaft reciprocatingly received within the handle tube, the handle shaft having a shaft first end spaced from a shaft second end, and the shaft first end including a shaft threaded boss, the shaft second end including handle mounting boss, with the shaft threaded boss and the handle mounting boss coaxially aligned relative to one another, the handle tube having an internally threaded collar coaxially aligned relative to the handle tube and to the handle shaft, the internally threaded collar fixedly mounted within the handle tube in adjacency to the tool head to threadedly receive the shaft threaded boss, and the handle shaft having further lock means cooperative with the handle tube for fixedly securing the handle shaft relative to the handle tube upon release of the shaft threaded boss relative to the internally threaded collar.

2. A tool handle as set forth in claim 1 wherein the further lock means comprises, the handle shaft having first lock pins, the first lock pins having a first diameter and are aligned relative to each other and fixedly mounted to the handle shaft in adjacency to the handle shaft second end, and second lock pins secured to the handle shaft and having a second diameter greater than said first diameter, the second lock pins being aligned relative to each other and being integrally mounted relative to the handle shaft in adjacency to the handle shaft first end, and a locking collar fixedly mounted within the handle tube in adjacency to the handle tube second end, the locking collar including spaced parallel grooves mounted within the locking collar in a facing relationship relative to the handle shaft, and the grooves each include a first groove portion having a first width substantially equal to the first diameter extending from said handle shaft second end into said locking collar, with each groove having a second groove portion aligned with said first groove portion extending from said first groove portion into said handle tube, with a T-shaped capture recess extending from each second groove portion intersecting said second groove portion to selectively receive an individual one of said first lock pins and an individual one of said second lock pins within said T-shaped capture recess relative to securement of said handle shaft within said handle tube in a first position, with said second lock pin received within a T-shaped capture recess when said handle shaft is extended from said handle tube in a second position.

3. A tool handle as set forth in claim 2 including a handle member mounted to said handle mounting boss, said handle member including a first end wall spaced from a second end wall, the first end wall including a threaded bore for receiving said handle mounting boss therewithin, and the handle including a reciprocating plunger mounted therethrough, a reservoir cylinder reciprocatably mounted within said handle member, said handle member having a first length, wherein said reservoir cylinder has a second length, the second length less than said first length, with a spring member captured between said reservoir cylinder and said first end wall, said reservoir cylinder having a plurality of reservoir cylinder apertures positioned therewithin, and said handle member having a plurality of handle member apertures misaligned relative to said reservoir cylinder apertures in a first position, whereupon said reservoir cylinder apertures and said handle member apertures are aligned within a plunger second position when the plunger is directed into said second end wall.

4. A tool handle as set forth in claim 3 including a handle strap formed of a memory retentive flexible material, having a handle strap first end secured to said plunger, and a handle strap second end secured to said handle mounting boss.

* * * * *